US007451827B2

(12) United States Patent
Carro

(10) Patent No.: US 7,451,827 B2
(45) Date of Patent: Nov. 18, 2008

(54) ANCHORING DEVICE FOR CASING PROCEDURES IN WELL BORES

(76) Inventor: Gustavo Ignacio Carro, San Martin 325, Piso° "B", Cipolletti - Provincia de Rio Negro, República Argentina (AR)

( * ) Notice: Subject to any disclaimer, the term of this patent is extended or adjusted under 35 U.S.C. 154(b) by 81 days.

(21) Appl. No.: 11/458,921

(22) Filed: Sep. 19, 2006

(65) Prior Publication Data

US 2007/0204987 A1 Sep. 6, 2007

(30) Foreign Application Priority Data

Mar. 6, 2006 (AR) ..... P20060100834

(51) Int. Cl.
*E21B 23/00* (2006.01)

(52) U.S. Cl. ..... 166/382; 166/212; 166/214; 166/217; 166/215

(58) Field of Classification Search ..... 166/212, 166/214, 217, 120, 215, 382
See application file for complete search history.

(56) References Cited

U.S. PATENT DOCUMENTS 1,050,127 A * 1/1913 Guiberson ..... 166/214
2,227,347 A * 12/1940 Johnson ..... 166/55.3
2,667,926 A * 2/1954 Alexander ..... 166/115
2,741,316 A * 4/1956 Long ..... 166/63
2,942,666 A * 6/1960 Boer et al. ..... 166/135
3,036,640 A * 5/1962 Clark, Jr. ..... 166/216
3,382,929 A * 5/1968 Plunk ..... 166/214
3,581,817 A * 6/1971 Kammerer, Jr. ..... 166/208
4,156,460 A * 5/1979 Crowe ..... 166/120
4,180,131 A * 12/1979 Chammas ..... 166/55
4,311,194 A * 1/1982 White ..... 166/120
4,444,252 A * 4/1984 Fisher, Jr. ..... 166/134
4,911,237 A * 3/1990 Melenyzer ..... 166/208
4,941,532 A * 7/1990 Hurt et al. ..... 166/216
4,971,146 A * 11/1990 Terrell ..... 166/55
5,361,834 A * 11/1994 Cox ..... 166/120
5,829,531 A * 11/1998 Hebert et al. ..... 166/382
6,311,778 B1 * 11/2001 Carisella et al. ..... 166/382
2004/0069502 A1 * 4/2004 Luke ..... 166/387
2005/0269073 A1 * 12/2005 Ruttley et al. ..... 166/209

* cited by examiner

*Primary Examiner*—Jennifer H Gay
*Assistant Examiner*—Cathleen R Hutchins
(74) *Attorney, Agent, or Firm*—Cottlieb, Rackman & Reisman

(57) ABSTRACT

A device for anchoring a casing into a well bore, the device comprising an anchor body mounted in a tool string and a plurality of radially expanding fingers that are mounted in a fingers assembly in a retracted position and they move to an extending position wherein the fingers extend radially from the tool string for anchor against the well bore wall.

5 Claims, 1 Drawing Sheet

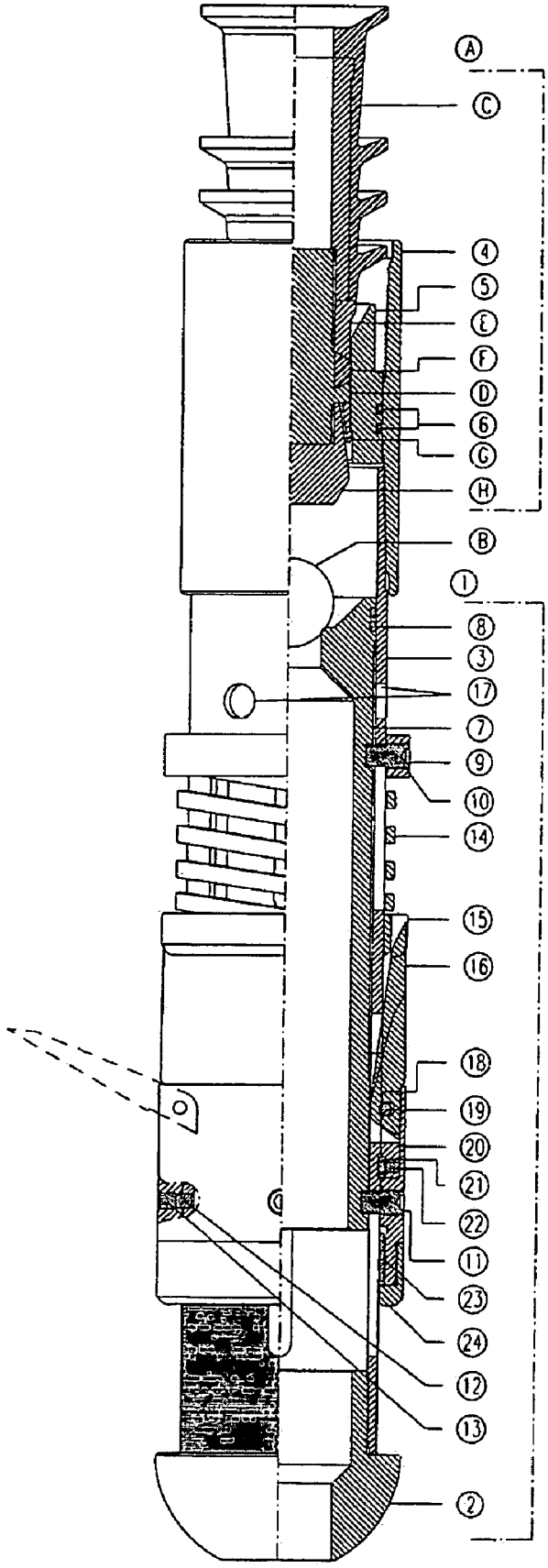
A
C
4
5
E
F
D
6
G
H
B
1
8
3
17
7
9
10
14
15
16
18
19
20
21
22
11
23
24
12
13
2

ANCHORING DEVICE FOR CASING PROCEDURES IN WELL BORES

BACKGROUND OF THE INVENTION

1. Field of the Invention

The present invention relates to a new device or assembly for anchoring and retaining a tubing or casing of the type employed in operations for lining or casing a well bore and more particularly the invention refers to an hydraulic anchor or anchoring device for installation of a casing into a well bore such as oil, water or gas well bores, with the anchor forming part of the tools employed in the well bore operations, wherein the inventive device or assembly is employed for anchoring, fixing and supporting the well tubing or casing thus permitting to carry out several operations, such as cementing operations, wherein the casing must be retained in position to prevent the upward movement thereof under the effects of floatability of the casing in the mass of the injected fluid or cement.

2. Description of the Prior Art

It is well know in the field of casing operations in well bores that the tubes or casings made of several materials like steel, plastics, glass fibers, epoxy resins, plastic resins and polymers, are affected by the floatability of the tube or casing material under the effect of the specific weight of the fluids injected through these tubes or casings during such operations, wherein the casing or tube tends to move upwardly when cementing fluids, circulations fluids, etc. are injected into the well bore. However, no devices or assemblies are known for preventing this inconveniency.

It would be therefore very convenient to have a new device or assembly that, assembled in the tool string generally applied in well bores, can be employed and actuated with the available resources for such tool string, for anchoring and retaining the tubing or casing in a desired position into the well bore in order to prevent the tubing from moving upwardly under the action of the injected fluids.

SUMMARY OF THE INVENTION

It is therefore an object of the invention to provide a device for anchoring a casing into a well bore, the device comprising an anchor body mounted in a tool string and a plurality of radially expanding fingers that are mounted in a fingers assembly in a retracted position, with the fingers being capable of moving into an extending position wherein the fingers extend radially from the tool string for anchor against a wall of the well bore.

It is still another object of the present invention to provide an anchoring assembly or device employed in the operations for installing a casing into a well bore, such as bores for oil, water, gas or any other fluid, either of the extraction or injection type, with the casing made of steel, or any metal but particularly when they are made of light materials such as plastics, polymers, reins epoxy, glass fibers and the like, wherein the casing tends to move upwardly under the effects of flotation in the fluids injected into the bore, wherein the inventive device is employed for anchoring the casing, more particularly when cementation operations are carried out, and wherein the anchor device includes a plurality of deployable anchoring fingers for anchoring into the well bore for preventing the casing from upwardly moving.

It is even another object of the present invention to provide an anchor device or device for anchoring a casing in well bore operations, wherein the device comprises a plurality of anchoring fingers pivotally mounted for moving between a retracted position wherein the fingers are aligned and out of contact to a wall of the well bore and an extended position wherein the fingers extend radially to anchor in the wall of the well bore.

It is a further object of the present invention to provide a device for anchoring a tubing or casing of the type employed for lining or casing a well bore, the device being combined with a tool string employed for casing the well bore, the device comprising:

an anchor body in said tubing;

a plurality of anchoring fingers pivotally mounted in said anchor body for moving between a retracted position wherein the fingers are aligned adjacent to the body and an extended position wherein the fingers extend transversely, preferably radially, out of the body, and a fingers-carrying assembly normally in a resting position for keeping the fingers in said retracted position, wherein the fingers-carrying assembly is mounted in the anchor body in a way that it moves along the body from the resting position to a releasing position wherein the fingers are released to move from the retracted position to the extended position.

The above and other objects, features and advantages of this invention will be better understood when taken in connection with the accompanying drawings and description.

BRIEF DESCRIPTION OF THE DRAWINGS

The present invention is illustrated by way of example in the following drawings wherein:

FIG. 1 shows a longitudinal cross-sectional view of a tool string including the device according to the invention.

DESCRIPTION OF THE PREFERRED EMBODIMENTS

Now referring in detail to an embodiment of the invention, the same refers to an anchoring assembly or device, also called hydraulic anchor, indicated by general reference number 1, for use in the anchoring of casings for gas, oil or water well bores, either extraction bores and injection bores. The device comprises a bottom head 2 that may be made of any appropriate material such as aluminum, cast iron, steel, plastics, polymers, etc. that is screwed to an anchor body 3 which in turn is threadably fixed to an upper head 4. Head 4 may have a locking means for receiving a plug 5 that is sealed into head 4 by means of sealing means such as O-rings 6.

A guiding sleeve 7 is housed within anchor body 3 and is sealed in its initial position, or resting position, against the anchor body with O-rings 8. The guiding sleeve is connected, at an upper portion or end thereof, to a spring-supporting ring or stop ring 9 which operates as a stop for a compression spring 14. Ring 9 is in turn connected in position by guiding pins 10 and is capable of moving longitudinally along upper grooves or notches in the anchor body. At a bottom or lower portion thereof, guiding sleeve 7 is connected to a stop lower ring 18 by locking screw or pins 11 that are capable of moving along lower notches in the anchor body. Guiding sleeve 7 is fixed in position in the anchor body by screw 13 and pins 12 capable of being sheared and cut.

Within lower locking ring 18 a plurality of fingers 16 are provided, which fingers may be short fingers, long fingers or may have an appropriate length according to the combination thereof with the tool and based also in the characteristics of the well bore. Fingers 16 are connected to a fingers-carrying ring 20 by means of pins 19 operating as pivot pins for the fingers thus permitting the fingers to pivot and deploy or move out from their aligned position into a position transverse to the tool in order to lock or anchor against a wall of the well bore. Fingers-carrying ring 20 is connected to at least one lower locking ring 21 by means of screws 22. Lower locking ring 21 is arranged around a shoulder of anchor body 3. Thus, the pivot mechanism of fingers 16 is enclosed by lower stop ring 18. A segment 23, connected to a stop segment 24, is housed within a lower end of lower stop ring 18. The purpose of segment 23, having a double threading, is to lock lower stop ring 18 in position relative to anchor body 3, which body includes a saw-type threading in its lower portion for causing segment 23 to move downwardly but to be locked when tending to move upwardly, thus forming a lock.

Fingers 16 have respective upper ends resting onto a fingers-carrying sleeve 15 that operates to deploy or move the fingers towards the extended position for the anchoring operation. Fingers carrying sleeve 15 is pushed by spring 14 when the tool is operated for anchoring purposes. Thus, sleeve 15 and rings 20, 21 form part of a fingers carrying assembly that operates to keep fingers 16 in a retracted or closed or plied position wherein they are aligned closely to anchor body, as shown in solid lines in the FIGURE. This retracted position is kept during the operations where the tubing or casing is moving down into the well bore and is placed into a desired position. This assembly also is operated to deploy or open or move the fingers into their extended position, as it is shown in phantom lines in the FIGURE, when the casing or tubing must be anchored in the desired position into the well bore. Segment 23 operates, by means of its saw teeth connected to the anchor body, to lock and retain this mechanism in the open or extended position also preventing the same to move back to the retracted position.

A sealing ball B and a moving dart A are also provided as further parts of the present tool. When ball B is in the position shown in the FIGURE, namely is sealing against an upper sealing seat of guiding sleeve 7, any fluid injected into the tool is interrupted through guiding sleeve and the fluid can not circulate along the interior of sleeve 7. Therefore, the sleeve is subject to the pushing force of the injected fluid and moved downwardly. Ball B may be made of any suitable material such as steel, aluminum, polymers, Teflon, cast iron, etc. Dart A operates to separate both pumped injected fluids, namely cement fluid, and displacement, actuating or moving fluid, through the entire pipe or tubing, to seat into plug or wedging piece 5 for fitting and sealing purposes. Dart A is comprised of plug body C with the fins of the dart being vulcanized in the plug body. The sizes and shapes of the fins may vary depending of the casing characteristics. Plug body C is connected to and sealed against a plug mandrel D that houses a resilient stop E and a seal F. A stop collar G is arranged at a lower end of plug mandrel D for locking moving dart A into wedging plug 5 and it is fixed to a plug head H.

In operation, an hydraulic anchor or anchoring device according to the present invention is employed by connecting or coupling the same to the end of the tubing or casing before the casing is lowered into the well bore. Once connected, the anchoring device and tool string is lowered into the well bore and placed at the desired depth wherein the casing must be anchored.

During the downward displacement of the tool string into the well bore towards the desired depth the fluid is freely circulating all along the tool and through the casing whereby, during lowering or at the desired depth, the fluid may be pumped and circulated for cleaning the well bore and/or the casing.

Up to this point all the mechanisms necessary to keep fingers 16 locked in the retracted position are fixed by means of shearing or breakable pins 12 thus permitting the free movement, downwardly and/or upwardly, of the tool into the well bore. Therefore, not only introduction but also the extraction of the tool and casing is permitted in an emergency situation. Thus, there is no risk that the anchoring fingers accidentally open or deploy what would result in the anchoring of the tool in an undesired location within the well bore.

When the anchoring device/casing assembly reaches the desired depth the weight of the casing coupled to the tool is sensed and the anchoring operation is begun. This weight is called the neutral point of the casing. Before this, and depending of the operative program to be carried out, it is possible to make cleaning and circulation pumping or injections to guarantee the clean conditions of the well bore and to measure circulation flows as well as other measuring operations. Afterwards, ball B is inserted and released to fall down into the tool. Fluid may be injected and pumped into the tool to push and help the ball to reach and seal against the sealing seat of guiding sleeve 7. Alternatively, one can wait while the ball falls down naturally and seat against sleeve 7. While the fluid is being injected, the indication that the ball has sealed into the seat of sleeve 7 is the sudden increase in the fluid pressure that may be measure at the instruments operating in the surface. In this point the pressure is increased to generate an increase in the force actuating against the plunger assembly formed by ball B and guiding sleeve 7 until reaching the desired breaking or shearing of breakable pins 12. In this moment, a sudden drop of the pressure in the system indicates that pins 12 are broken and that guiding sleeve 12 commenced to move downwardly. The pressure converted into force for shearing the pins will depend on the physical and operative conditions of the well bore and it may be measured and controlled on the basis of the number, hardness and material of pins 12.

Once the pins have been cut, guiding sleeve 7 follows moving downwardly, thus downwardly pushing stop ring 9 that is connected to guiding sleeve 7 by means of guiding pins 10 moving along the grooves in body 3. Stop ring 9 pushes spring 14 that is mounted under a pre-compression. Spring 14 in turn pushes fingers-carrying sleeve 15 and therefore when sleeve 15 is moved downwardly under the action of spring 14 fingers 16 are released from their locked retracted position and are caused to deploy or open. It must be taken into account that sleeve 7 is connected to two main parts namely spring stop ring 9 and the mechanism for releasing fingers 16, with stop ring 9 being in charge of pushing spring 14 to provide sleeve 15 with the necessary force or pushing to guarantee the effective opening of the fingers. To have a clearer idea of the movements occurring in the tool, it must be considered that the two movements simultaneously generated in the system are due to the fact that guiding sleeve 7 is connected to the above two parts by means of pins 10 and 11. Therefore, in addition to the movement of the upper part as disclosed above, there is a movement of the lower part as disclosed below.

Once pins 12 are cut, guiding sleeve 7 follows moving downwardly also moving all the system for releasing fingers 16. Since lower stop ring 18 is connected to guiding sleeve 7 by guiding pin 11, ring 18 moves downwardly and removes the support for the lower part of fingers 16 thus permitting the fingers to rotate or pivot and open or deploy radially to a position extended out of the anchor body. This operation is also helped by fingers-carrying sleeve 15 that is pushed by spring 14 to open fingers 16 against the wall of the well bore. Guiding sleeve 7 follows its downward movement under the force of the piston or plunger assembly with ball B sealingly seated on the set of sleeve 7 until the lower portion of sleeve 7 reaches and passes over circulation orifices or windows 17. All along this movement, segment 23, that is arranged in the lower part of lower stop ring 18 and connected to stop segment 24, slides downwardly under the pushing action of the lower inner thread of lower stop ring 18 and its inner thread slides downwardly over the lower saw-tooth thread of anchor body 3. In this manner the geometry of the saw tooth thread guarantees the sliding in downward direction but the retention in the contrary direction, namely the upward direction, thus permitting to fix the system and not permitting to restore it.

At this stage of the operations a pressure drop will be detected at the surface of the well bore and the admission of the pumped fluid will increase. At that moment the effectiveness of the anchoring of the casing may be tested by upwardly pulling from the casing to check whether the fingers are anchored. This test will cause the fingers to anchor more and more into the wall of the well bore thus effectively fixing the casing into position. Then, other operations, such as circulation of fluid or cementing of the casing, may be carried out without risk of flotation of the casing and tool.

When carrying out operations for cementing the casing into the well bore, for example, a wedge system arranged in the dart A, in the upper part of the hydraulic anchor, operates as describe below. Once the anchor device is fixed into the well bore, the operation for cementing the casing to the well bore is commenced and which operation comprises injecting and pumping cement directly through and along the tubing or casing. The cement will be displaced with dart A under the effect of a fluid for placing the cement into a space between the wall of the well bore and the casing. The fluids will circulate in this order, cement, dart A and displacement fluid. The cement will circulate within the casing, Hill pass through the anchor device and Hill move upwardly within the annular space defined between the wall of the well bore and the casing up to the moment that dart A wedges into plug 5. Dart A will move after the cement pushed by the displacement fluid. The ideal situation would be that all the necessary cement is occupying the annular space, dart A is wedged into plug 5 and displacement fluid casing.

Once the operation has ended and dart A is wedged into plug 5 a sudden increase in the pressure will be detected in the surface which increase will indicate that dart A has been fixed into and sealed in plug 5. Now the pumping may be interrupted and the pressure into the casing may be released to test the effectiveness of the seal and fixing of the dart. One way to test the sealing effect and edging fixing of dart A is to open the circulation into the casing and see whether the fluid is not pushed outwardly under the weight of the cement.

In this manner, the casing is clean and free of cement up to anchoring device 1. Then the operation follows awaiting the cement to set and harden and, after that, the entire cleaning of the well bore may be carried out by inserting a rotating tool clean, to calibrate and to destroy dart A, ball B, guiding sleeve 7 and lower head 2 which may be easily removed because they are made of materials easy to destroy under rotation or grinding, such as aluminum, polymers, rubbers, etc. Thus, the well bore is entirely clean and cemented all along from the surface to the bottom thereof.

While preferred embodiments of the present invention have been illustrated and described, it will be obvious to those skilled in the art that various changes and modifications may be made therein without departing from the scope of the invention as defined in the appended claims.

I claim:

1. A device for anchoring a tubing of the type employed for casing a well bore, the device being combined with a tool string employed for installing the tubing into the well bore, the device comprising:

an anchor body in said tubing;

a plurality of anchoring fingers pivotally mounted in said anchor body for moving between a retracted position wherein the fingers are aligned closed to the body and an extended position wherein the fingers extend transversely out of the body, a fingers-carrying assembly for keeping the fingers in said retracted position, wherein the fingers-carrying assembly is mounted in the anchor body and is capable of moving along the anchor body from a resting position, wherein the fingers are kept in the retracted position, to a releasing position, wherein the fingers are released to move to the extended position, breakable pins for retaining the fingers-carrying assembly in a resting position wherein the fingers are in their retracted position, the anchor body including a guiding sleeve mounted inside the anchor body and retained by the breakable pins in a resting position together with the fingers-carrying assembly, the guiding sleeve being a tubular sleeve defining a fluid circulation conduit having an upper end with a sealing seat and a lower end, a sealing ball piece being mounted in a manner that the ball may seat in the sealing seat and when the ball piece is seated against the sealing seat the circulation of fluid through the fluid circulation conduit is interrupted, wherein said pins for retaining the guiding sleeve being mounted at the lower end of the conduit, and wherein the guiding sleeve is fixed to a projecting ring forming a stop for a compression ring and mounted between said projecting ring and a fingers carrying sleeve.

2. The device of claim 1, wherein the fingers-carrying assembly comprises said fingers-carrying sleeve which is capable of extending said fingers and a lower stop ring for retaining the fingers retracted into the resting position, and wherein a segment is connected to a stop segment and to the lower stop ring in position relative to the anchor body.

3. The device of claim 1 wherein the anchor body has at least one opening for circulation of fluid and the at least one opening is closed by the guiding sleeve when in its resting position with the at least one opening defining a fluid communication between an interior of the tubing and an interior of the well bore, outside the tubing, when the guiding sleeve has moved out from its resting position uncovering the at least one opening.

4. The device of claim 2, wherein each finger has a lower end pivotally connected to a fingers-carrying ring by means of a pivot shaft.

5. The device of claim 2, wherein the anchor body includes a saw-type threading at a lower portion thereof for causing said segment to move downwardly but to be locked when tending to move upwardly, thus forming a lock.

* * * * *